United States Patent [19]

Carter

[11] Patent Number: 4,623,315

[45] Date of Patent: Nov. 18, 1986

[54] OARLOCK

[75] Inventor: Christopher E. Carter, Fort Collins, Colo.

[73] Assignee: Research Corporation, New York, N.Y.

[21] Appl. No.: 696,135

[22] Filed: Jan. 29, 1985

[51] Int. Cl.[4] ..... B63H 16/06

[52] U.S. Cl. ..... 440/106; 440/104

[58] Field of Search ..... 43/24; 242/157 C; 440/106, 107, 108, 109, 101, 104; 114/218, 230

[56] References Cited

U.S. PATENT DOCUMENTS

| | | | |
|---|---|---|---|
| 190,131 | 5/1877 | Danielson | 440/106 |
| 394,639 | 12/1888 | Briggs | 440/106 |
| 1,145,156 | 7/1915 | Malchow | 440/106 |
| 1,990,114 | 5/1933 | Burr | 440/106 |
| 2,286,769 | 4/1940 | Sparkes | 440/106 |
| 2,529,357 | 5/1949 | Shutter | 440/106 |
| 3,125,978 | 3/1964 | Faul | 114/218 |

FOREIGN PATENT DOCUMENTS

| | | | |
|---|---|---|---|
| 1212125 | 11/1970 | United Kingdom | 440/106 |

*Primary Examiner*—Trygve M. Blix
*Assistant Examiner*—Edwin L. Swinehart
*Attorney, Agent, or Firm*—Scully, Scott, Murphy & Presser

[57] ABSTRACT

An oarlock comprising a base, a front leg extending upward therefrom and having a rearwardly extending top portion, and a rear leg extending upward from the base and having a forwardly extending top portion. The top portion of the rear leg is spaced from the top portion of the front leg and projects above and forward of a top end of the front leg. The legs form a ring for holding an oar, and the top portions of the legs form an opening for passing the oar into and out of the interior of the ring.

12 Claims, 5 Drawing Figures

OARLOCK

BACKGROUND OF THE INVENTION

This invention generally relates to oarlocks, and more particularly to oarlocks designed to readily receive oars and to hold those oars in place during normal and abnormal conditions.

Oarlocks are secured to the sides of boats and are used, first, to support and hold oars while those oars are being used to row a boat and, second, to provide the necessary reactionary forces between the boat and the oars to propel the boat through the water. Normally, rowboats are provided with either two or four oarlocks. For example, boats that are used by lifeguards to reach swimmers who need help usually have two oarlocks near the front of the boat, with one of these oarlocks on the left side and the other one on the right side of the boat, and two oarlocks closer to the middle of the boat, again with one of these oarlocks on the left side and the other one on the right side of the boat. One lifeguard stands in the stern of the boat, facing forward, and rows with two oars extending through the front pair of oarlocks. A second lifeguard sits in the bow of the boat, facing rearward, and rows with two oars extending through the second pair of oarlocks.

While there are many different specific kinds, generally oarlocks have a U-shaped upper part and either a bottom stem or pin, or a bottom connecting base. An oarlock with a bottom stem or pin is secured to a boat by sliding the stem or pin into an opening formed by a bracket that is bolted to a side of the boat. An oarlock with a bottom connecting base is secured to a boat by simply bolting the base itself to the gunnel or top sidewall of the boat. One difficulty with oarlocks of these general types is that oars occasionally come out of the tops of the oarlocks. This may be caused, for instance, by a large wave, by failing to immerse the blade of the oar into the water during a rowing stroke, or by immersing the oarblade too deeply into the water. Often, when an oar comes out of an oarlock, the rower is unable to hold onto the oar and the oar is lost overboard.

The consequences of a lost oar are, at the very least, inconvenient, and, at worst, tragic. For instance, if the boat is in very heavy waves, without the proper number of oars, the rower or rowers may be unable to control movement of the boat properly, and waves may drive the boat against rocks or other obstructions that may literally tear the boat apart. If the boat is being rowed to save a troubled swimmer, the loss of the oar may cause the boat to fail to reach the swimmer in time to save his or her life. In addition, rowboats are often raced, and a rower may lose valuable time if an oar comes out of an oarlock during a race.

In addition, occasionally it is necessary to eject an oar through an oarlock in order to prevent damage to the oar. For example, if an obstacle such as a rock is in the path of the blade of an oar, often the easiest, quickest and surest way to move the oar blade out of the way of the obstruction is to eject the oar outward through the oarlock, along the longitudinal axis of the oar. If the oar cannot be released in this way, it may be virtually impossible to prevent the obstruction from damaging or breaking the oar. While releasing the oar through the oarlock is usually undesirable since it normally requires extra time and effort to subsequently retrieve the oar, releasing the oar in this way is better than having the oar damaged or broken.

Various prior art oarlocks have been specifically designed to reduce the risk that oars may come out of the tops of the oarlocks. Such oarlocks are shown, for instance, in U.S. Pat. Nos. 2,286,769 and 2,529,357. The oarlocks disclosed in these patents have open top ends, however, and thus do not completely prevent an oar from moving vertically out of the tops of the oarlocks. Moreover, the oarlocks disclosed in both of these patents are designed to prevent an oar from sliding through or off the oarlocks along the longitudinal axis of the oar. Because of this, it is difficult for a rower to eject the oar through the oarlocks when necessary.

SUMMARY OF THE INVENTION

An object of this invention is to hold an oar securely in an oarlock, and more particularly to prevent the oar from inadvertently coming out of the top of the oarlock.

Another object of the present invention is to hold an oar securely in an oarlock during normal and abnormal conditions while also allowing the oar to slide through the oarlock along the longitudinal axis of the oar.

A further object of this invention is to provide an oarlock that will securely hold an oar during normal and abnormal conditions and that is designed so that the oar may be easily inserted into and removed from the oarlock when desired.

Still another object of the present invention is to positively capture an oar within a one piece oarlock without requiring any moving parts or pieces on the oarlock.

These and other objectives are obtained with an oarlock comprising a base, a front leg, and a rear leg. The front leg extends upward from the base and has a rearwardly extending top portion. The rear leg extends upward from the base and has a forwardly extending top portion. The top portion of the rear leg is spaced from the top portion of the front leg and projects above and forward of a top end of the front leg. The legs form a ring for holding an oar, and the top portions of the legs form an opening for passing the oar into and out of the interior of the ring.

Preferably, this ring has a generally ellipsoidal shape, with the width of the ring greater than its inside clearance height, and with that inside clearance height greater than the maximum thickness of the shaft of the oar which is used with the oarlock. In comparison to an oarlock having a generally circular ring, the ellipsoidal shape of the oarlock of the present invention permits longer rowing strokes while still restricting bouncing and other irregular upward motion of the oar during the rowing stroke. With the inside clearance height of the ring greater than the maximum thickness of the shaft of the oar used with oarlock, that oar shaft can be forced outward through the oarlock when necessary, for instance to move the oarblade away from an obstruction in the water.

Further benefits and advantages of the invention will become apparent from a consideration of the following detailed description given with reference to the accompanying drawing, which specifies and shows preferred embodiments of the invention.

A DETAILED DESCRIPTION OF THE PREFERRED EMBODIMENTS

Figure 1:
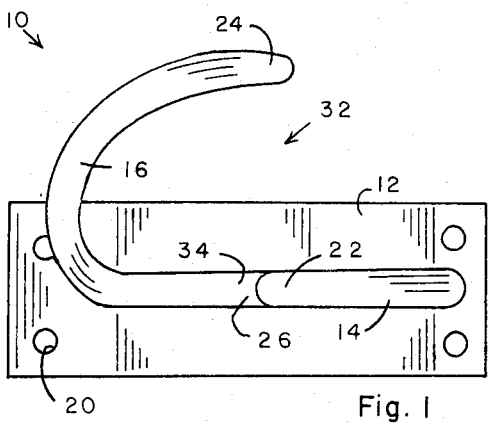
FIG. 1 is a top view of an oarlock embodying the present invention.
Figure 2:
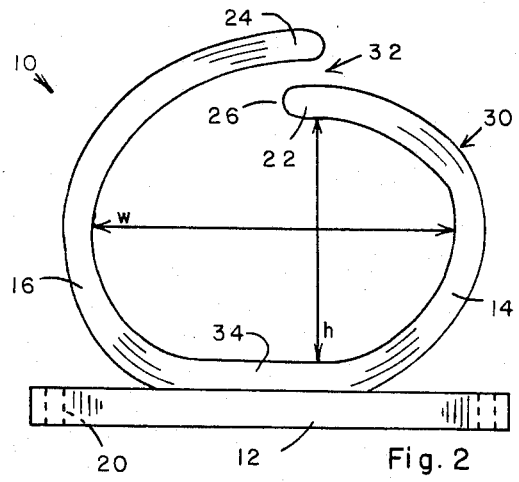
FIG. 2 is a side view of the oarlock shown in FIG. 1.
Figure 3:
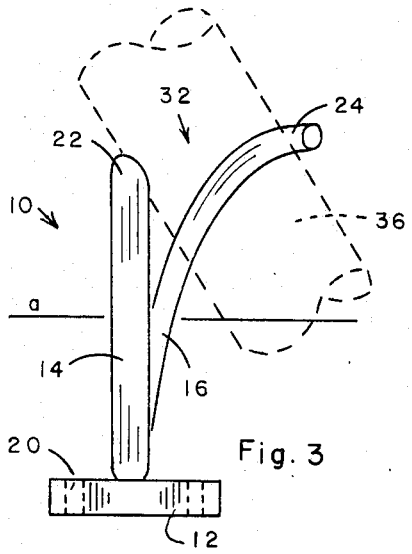
FIG. 3 is a front view of the oarlock illustrated in FIG. 1.

FIGS. 1 through 3 illustrate oarlock 10 comprising base 2 and first and second legs 14 and 16. Legs 14 and 16 are referred to as the front and rear legs of oarlock 10 respectively because the oarlock is intended to be secured to a boat with the major portion of leg 14 forward of the major portion of leg 16. As viewed in FIGS. 1 and 2, the right side of oarlock 10 is referred to as the front side thereof, and the left side of the oarlock is referred to as the rear side thereof. Consistent with this, as used herein, the term forward refers to the left-to-right direction in FIGS. 1 and 2, and the word rearward refers to the right-to-left direction in FIGS. 1 and 2.

Base 12 is provided for securing oarlock 10 to a gunnel, the top sidewall, of a boat. This may be done by inserting a plurality of bolts (not shown) through openings 20, which extend through base 12, and into threaded openings in the gunnel of a boat. As shown if FIGS. 1, 2 and 3, base 12 has a rectangular shape, although the base may have other suitable shapes and sizes.

Front leg 14 extends upward from a front portion of base 12, and has a rearwardly extending, generally horizontal top portion 22. Rear leg 16 extends upward from a rear portion of base 12 and has a forwardly extending, generally horizontal top portion 24. Top portion 24 of rear leg 16 is spaced from top portion 22 of front leg 14 and projects above and forward of a top end 26 of the front leg. More specifically, top portion 24 of rear leg 16 extends through vertical and horizontal planes that are contiguous to top end 26 of front leg 14.

With this arrangement, legs 14 and 16 form ring 30 for holding an oar, and top portions 22 and 24 of those legs annularly close the top of the ring—that is they annularly project past each other—to prevent an oar positioned within the ring from moving vertically directly upward out of the top of the ring. If an oar that is supported with ring 30 tends to bounce upward, the oar will simply strike either top portion 22 or top portion 24 and be held within ring 30 by those top portions of legs 14 and 16. At the same time, top portions 22 and 24 of legs 14 and 16 form an opening 32 for passing an oar into and out from the interior of ring 30. More specifically, top portion 24 of rear leg 16 includes a first laterally facing surface segment, and a downwardly facing surface segment extending rearward from a top end of the rear leg; and top portion 22 of front leg 14 includes a second laterally facing surface segment opposite the above-mentioned first laterally facing surface segment, and an upwardly facing surface segment extending forward from the top end of the front leg. This downwardly facing surface segment of top portion 24 of rear leg 16 is at a greater vertical height than the above-described upwardly facing surface segment of top portion 22 of front leg 14, and the above-mentioned laterally facing surface segments of the top portions of the front and rear legs are laterally spaced apart; and, in this way, top portions 22 and 24 of legs 14 and 16 form a horizontally and vertically extending opening 32 for passing the oar into and out of ring 30. With the above-described arrangement, oarlock 10 positively captures an oar held therein, and this is done without requiring the oarlock to have any moving or pivoting parts or any concomitant hinges, springs or hooks to close the top of the oarlock after an oar has been moved into the interior of ring 30.

With the embodiment of the invention shown in FIGS. 1, 2, and 3, oarlock 10 also includes bottom connecting leg 34 which forms a continuation of and extends between the bottom ends of front and rear legs 14 and 16 and which closes the bottom of ring 30. Connecting leg 34 is not necessary to this embodiment of the invention and, alternately, the bottom of ring 30 may be closed by base 12 itself.

With particular reference to FIG. 2, preferably ring 30 has a generally ellipsoidal shape. In particular, each leg 14 and 16 is formed in the general shape of a half ellipse with the rear leg being slightly longer than the front leg. Legs 14 and 16 extend upward from base 12 with the lower halves of the legs extending away from each other and the upper halves of the legs extending toward and then annularly past each other. The inside width of the ellipse formed by ring 30—that is, the maximum horizontal distance w between the inside surfaces of front and rear legs 14 and 16 in the plane of FIG. 2—is greater than the inside clearance height of the ellipse—the maximum vertical distance h across the interior of the ring in the plane of FIG. 2, below the inside surface of top portion 22 of the front leg.

In comparison to an oarlock having a generally circular ring, the ellipsoidal shape of oarlock 10 permits greater movement of an oar across the width of the ring, which permits longer rowing strokes, while still restricting to the same extent upward movement of the oar. Preferably, the inside clearance height of ring 30 is greater than the maximum transverse thickness of the shaft or handle of the oar used with oarlock 10. In this way, the oar handle can be pushed outward through the inside of ring 30, along the longitudinal axis of the oar. If an obstruction is in the path of the blade of the oar, a rower is easily able to push the oar handle quickly through oarlock 10, away from the boat, and, in this way, push the oarblade out of the way of the impediment. This prevents the obstacle in the water from damaging or breaking the oarblade and allows the rower, after retrieving the oar, to continue using the same oar without further interruption.

In addition, with reference to FIGS. 1 and 3, preferably front leg 14 stands substantially vertically, while rear leg 16 curves upwardly, laterally away from the front leg (to the right as viewed in FIG. 3). At the same time, legs 14 and 16 are preferably positioned so that, when an oar is inside ring 30, the legs hold the oar with at least a portion of one of the legs located directly above the oar. This prevents the oar from moving out of ring 30 through opening 32 when the oar is held in a horizontal position.

FIG. 3 shows in broken lines a portion of an oar 36 as it is inserted through opening 32. Legs 14 and 16 are dimensioned and positioned so that, in order to pass through opening 32, an oar must be located in a comparatively specific position and orientation extending forward and downward relative to the axis of ring 30—that is, the axis, a, (shown in FIG. 3) through the center of the ring, perpendicular to the plane of FIG. 2. For example, preferably the vertical component of the distance between top portions 22 and 24 of legs 14 and 16 is less than the lateral horizontal component of that distance, and oar 36 must thus be located at a comparatively large angle to the horizontal in order to pass through opening 32. An oar may be easily located in that position and orientation when it is desired to move the oar into or out of ring 30. However, it is very unlikely that the oar will assume that specific position and orientation during normal rowing of a boat, or even during atypical conditions that might be encountered while rowing a boat. This virtually insures that the oar will not pass through opening 32 while the oar is being used to row the boat.

Figure 4:
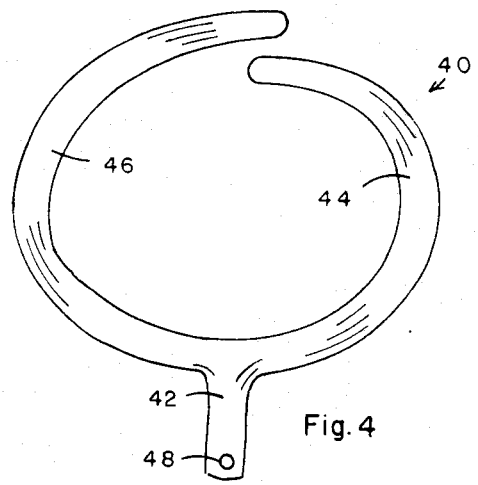
FIG. 4 is a side view of an alternate oarlock also in accordance with this invention.

FIG. 4 shows an alternate embodiment of this invention, showing oarlock 40 of the pin or stem type. With this embodiment, the base of oarlock 40 comprises a pin or stem 42, and the front and rear legs 44 and 46 extend upward from top ends of that stem. In use, oarlock 40 is secured to a boat by inserting the stem axially downward into or through a suitable opening formed by a bracket that is bolted to the side of the boat. A locking pin (not shown) may then be secured in transverse opening 48 of stem 42 to prevent oarlock 40 from rotating or inadvertently moving back upward out of its secured position.

With either embodiment of the present invention discussed above, the base and legs of the oarlock may be integrally formed together as a single piece. Alternately, the base and legs may be formed separately and then securely welded or bolted together. Preferably, further, the oarlocks are formed from manganese bronze, including a small amount of tin to improve the resistance to corrosion and to increase the tensile strength of the oarlocks. Stainless steel is also suitable material for the oarlocks.

Figure 5:
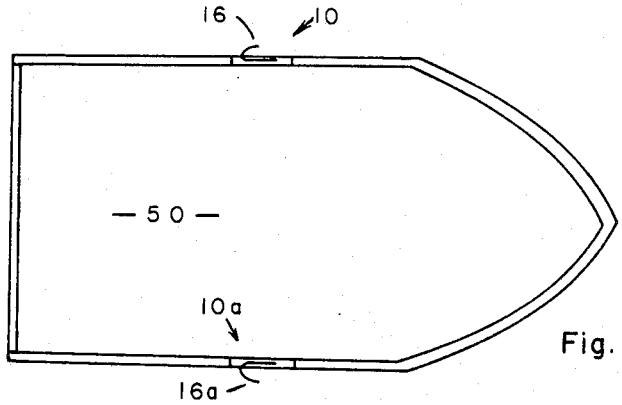
FIG. 5 is a schematic view of a boat equipped with a pair of oarlocks of the type shown in FIGS. 1, 2 and 3.

FIG. 5 illustrates boat 50 having a pair of oarlocks 10 and 10*a* secured to the left and right sidewalls of the boat respectrvely. Oarlocks 10 and 10*a* are identical in all important respects except that the rear legs 16 and 16*a* of these oarlocks curve upwardly outwardly in opposite lateral directions. Oarlocks 10 and 10*a* are secured to boat 50 with rear legs of the oarlocks extending upwardly laterally away from the longitudinal centerline of the boat. It has been found that if an oarlock 10 or 10*a* is positioned with a rear leg 16 or 16*a* a curving inward, toward the interior of boat 50, there is a tendency for an oar that is held within the oarlock to hit the rear leg of the oarlock accidentally during the rowing stroke. This problem is eliminated by securing oarlocks 10 and 10*a* to boat 50 with rear legs 16 and 16*a* curving outward.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. An oarlock comprising:

a base;

a rigid front leg extending upward from the base, and having a gnerally horizontally and rearwarly extending top portion; and a rigid rear leg extending upward from the base, curving upwardly laterally away from the front leg, and having a generally horizontally and forwardly extending top portion spaced from the top portion of the front leg and projecting above and forward of a top end of the front leg, wherein the legs form a ring for holding an oar and are positioned to prevent movement of the oar out of the ring through the space between the top portions of the legs when the oar is horizontal;

the top portion of the rear leg including a first laterally facing surface segment, and a downwardly facing surface segment extending rearward from a top end of the rear leg;

a top portion of the front leg including a second laterally facing surface segment opposite the first laterally facing surface segment, and an upwardly facing surface segment extending forward from the top end of the front leg;

the downwardly facing surface segment of the top portion of the rear leg being at a greater vertical height than the upwardly facing surface segment of the top portion of the front leg, and the laterally facing surface segments of the top portions of the front and rear legs being laterally spaced apart, wherein the top portions of the legs form a horizontally and vertically extending opening for passing the oar into and out of the ring.

2. An oarlock according to claim 1 wherein:

the ring has a generally ellipsoidal shape, and a width and an inside clearance height; and the width of the ring is greater than its inside clearance height.

3. An oarlock according to claim 1 wherein:

the base has a generally rectangular shape;

the rear leg extends upward from a rear portion of the base; and the front leg extends upward from a front portion of the base.

4. An oarlock according to claim 1 wherein:

the base comprises an axially extending stem; and the front and rear legs extend upward from a top end of the stem.

5. An oarlock according to claim 1 for use with an oar having a handle with a longitudinal axis and a predetermined maximum transverse thickness, and wherein the inside clearance height of the ring is greater than the maximum transverse thickness of the handle to allow the handle to pass through the inside of the ring along the longitudinal axis of the oar of the oar handle.

6. An oarlock according to claim 1 for use with an oar having a handle with a minimum thickness greater than the lateral horizontal component of the distance between the top portions of the legs, and wherein, when the oar is in the oarlock, the legs hold the oar with at least a portion of one of the legs extending directly above the oar, and prevent the oar from moving vertically upward, in a horizontal position, out of the oarlock.

7. An oarlock according to claim 6 wherein the vertical component of the distance between the top portions of the legs is less than the horizontal lateral component of said distance, whereby the oar must be pivoted to a substantial angle to the horizontal to pass through the opening formed by the top portions of the legs.

8. A boat comprising:

a body including left and right sidewalls and having a logitudinal centerline;

a left oarlock including (i) a base secured to the left sidewall, (ii) a rigid front leg extending upward from the base and having a generally horizontally and rearwardly extending top portion, and (iii) a rigid rear leg extending upward from the base and laterally away from the longitudinal centerline of the body, and having a generally horizontally and forwardly extending top portion spaced from the portion of the front leg and projecting above and forward of a top end of the front leg, wherein the legs form a first ring for holding a first oar, and the top portion of the rear leg including a first laterally facing surface segment, and a downwardly facing surface segment extending rearward from a top end of the rear leg, the top portion of the front leg including a second laterally facing surface segment opposite the first laterally facing surface segment, and an upwardly facing surface segment extending forward from the top end of the front leg, the downwardly facing surface segment of the top portion of the rear leg being at a greater vertical height than the upwardly facing surface segment of the top portion of the front leg, and the laterally facing surface segments of the top portions of the front and rear legs being laterally spaced apart, wherein the top portions of the legs form a first horizontally and vertically extending opening for passing the first oar into and out of the first ring; and a right oarlock including (i) a base secured to the right sidewall, (ii) a rigid front leg extending upward from the base of the right oarlock and having a generally horizontally and rearwardly extending top portion, and (iii) a rigid rear leg extending upward from the base of the right oarlock and laterally away from the longitudinal centerline of the body, and having a generally horizontally and forwardly extending top portion spaced from the top portion of the front leg of the right oarlock and projecting above and forward of a top of the front leg of the right oarlock, wherein the top portions of the legs of the right oarlock form a second ring for holding a second oar, and the top portion of the rear leg of the right oarlock including a third laterally facing surface segment, and a downwardly facing surface segment extending rearward form a top end of the rear leg of the right oarlock, the top portion of the front leg of the right oarlock including a fourth laterally facing surface segment opposite the third laterally facing surface segment, and an upwardly facing surface segment extending the downwardly facing surface segment of the top portion of the rear leg of the right oarlock being at a greater vertical height than the upwardly facing surface segment of the top portion of the front leg of the right oarlock, and the laterally facing surface segments of the top portions of the front and rear legs of the right oarlock being laterally spaced apart, wherein the top portions of the legs of the right oarlock form a second horizontally and vertically extending opening for passing a second oar into and out of the second ring.

9. A boat according to claim 8 wherein the front legs of the left and right oarlocks stand vertically.

10. A boat comprising:

a body including left and right sidewalls and having a longitudinal centerline;

a pair of oars;

a left oarlock including (i) a base secured to the left sidewall, (ii) a rigid front leg extending upward from the base and having a generally horizontally and rearwardly extending top portion, and (iii) a rigid rear leg extending upward from the base and laterally away from the longitudinal centerline of the body, and having a generally horizontally and forwardly extending top portion projecting above and forward of a top end of the front leg, wherein the legs from a left ring for holding the first of the pair of oars, the top portion of the rear leg including a first laterally facing surface segment, and a downwardly facing surface segment extending rearward from a top end of the rear leg, the top portion of the front leg including a second laterally facing surface segment opposite the first laterally facing surface segment, and an upwardly facing surface segment extending forward from the top end of the front leg, the downwardly facing surface segment of the top portion of the rear leg being at a greater vertical height than the upwardly facing surface segment of the top portion of the front leg, and the laterally facing surface segments of the top portions of the front and rear legs being laterally spaced part, wherein the top portions of the legs form a first horizontally and vertically extending opening for passing the first oar into and out of the left ring; and a right oarlock including (i) a base secured to the right sidewall, (ii) a rigid front leg extending upward from the base of the right oarlock and having a generally horizontally and rearwardly extending top portion, and (iii) a rigid rear leg extending upward from the base of the right orlock and laterally away from the longitudinal centerline of the body, and having a generally horizontally and forwardly extneding top portion projecting forward of and above a top end of the front leg of the right oarlock, wherein the legs of the right oarlock form a right ring for holding the second of the pair of oars, the top portion of the rear leg of the right oarlock including a third laterally facing surface segment, and a downwardly facing surface segment extending rearward from a top end of the rear leg of the right oarlock, the top portion of the front leg of the right oarlock including a fourth laterally facing surface segment opposite the third laterally facing surface segment, and an upwardly facing surface segment extending forward from the top end of the front leg of the right oarlock, and the downwardly facing surface segment of the top portion of the rear leg of the right oarlock being at a greater vertical height than the upwardly facing surface segment of the top portion of the front leg of the right oarlock, and the laterally facing surface segments of the top portions of the front and rear legs of the right oarlock being laterally spaced apart, wherein the top portions of the legs of the right oarlock form a second horizontally and vertically extending opening for passing the second oar into and out of the right ring.

11. An oarlock according to claim 10 wherein:

the first oar includes a handle with a minimum thickness greater than the lateral horizontal component of the distance between the top portions of the legs of the left oarlock, and when the first oar is in the left oarlock, the legs thereof hold the first oar with at least a portion of one of the legs of the left oarlock extending directly above the first oar; and the second oar includes a handle with a minimum thickness greater than the lateral horizontal component of the distance between the top portions of the legs of the right oarlock, and when the second oar is in the right oarlock, the legs thereof hold the second oar with at least a portion of one of the legs of the right oarlock extending directly above the second oar.

12. An oarlock according to claim 11 wherein:

each of the left and right rings has a generally ellipsoidal shape, and a width and an inside clearance height;

the width of each ring is greater than its inside clearance height;

the handle of the first oar has a maximum transverse thickness less than the inside clearance height of the left ring to allow the handle of the first oar to pass through the inside of the left ring; and the handle of the second oar has a maximum transverse thickness less than the inside clearance height of the right ring to allow the handle of the second oar to pass through the inside of the right ring.

* * * * *